United States Patent [19]

Foxman

[11] Patent Number: 4,833,731

[45] Date of Patent: May 30, 1989

[54] REVERSIBLE LAP ROBE

[75] Inventor: Charles Foxman, St. Louis County, Mo.

[73] Assignee: Medtex Products, Inc., Maryland Heights, Mo.

[21] Appl. No.: 199,159

[22] Filed: May 26, 1988

[51] Int. Cl.[4] ..... A41D 13/04

[52] U.S. Cl. ..... 2/48; 2/47; 2/69; 2/DIG. 7

[58] Field of Search ..... 2/46, 47, 48, 69

[56] References Cited

U.S. PATENT DOCUMENTS

| | | | |
|---|---|---|---|
| 812,486 | 2/1906 | Dix | 2/46 |
| 3,727,238 | 4/1973 | Wolfson | 2/69 |
| 3,879,762 | 4/1975 | Herman | 2/48 |

*Primary Examiner*—Werner H. Schroeder
*Assistant Examiner*—D. Biefeld
*Attorney, Agent, or Firm*—Polster, Polster and Lucchesi

[57] ABSTRACT

A lap robe for wheel chair or sitting patients is disclosed as including a waist section having detachable fastener elements attached thereto, and a lower body and leg wrapping section which is attached to the waist section. The lower body and leg wrapping section includes upper and lower portions, with the upper portion extending laterally outwardly from the lower portion, an opposite sides of the lower body and leg wrapping section. This enables the lap robe to be easily and conveniently placed about a patient, while the upper portion thereof generally conforms to the patient's lower body and thighs, when both in a standing and sitting position. The lower portion of the lower body and leg wrapping section covers the lower leg areas of the patient. The lap robe is preferably made from a synthetic fiber healthcare fabric that has a repeating pattern of synthetic fiber filaments arranged in an open work construction to provide both a thermal barrier and an ornamental appearance in a light-weight fabric construction.

7 Claims, 1 Drawing Sheet

REVERSIBLE LAP ROBE

BACKGROUND OF THE INVENTION

Institutional healthcare for people, as they become part of the "vintage" generation, is increasingly popular, particularly in industrial societies. Retirement communities and nursing homes have continued to grow to meet the increasing needs of populations whose average age and life span also continues to increase. Thus, there are special needs for innovative healthcare products for this "vintage" generation who find it convenient or necessary to live in institutional healthcare facilities.

One particular area that requires an innovative healthcare product relates to the problems that people have when confined to wheelchairs, when a medical abnormality (i.e., one leg or disfigurement) is exposed when sitting, or when comfort and convenience is desired in cold weather, while sitting or moving about short distances. Currently, a variety of different types and kinds of blankets and other covers are used to drape over a persons' lower body and legs, when sitting. Anyone who has tended the "vintage" generation knows how difficult it is to keep the blankets and other covers "in place". This is even more of a problem in institutional facilities with patients who are unable to care for themselves. A typical blanket or other cover may also not afford the comfort, while providing convenience of movement over short distances. Finally, the non-uniformity of various blankets and other covers creates extra problems in cleaning a variety of different products. As will be appreciated, the cost of processing in washing and cleaning healthcare products continues to increase, because of the increasing cost of labor and energy.

For all of the above reasons, there is a long standing need for a healthcare product that overcomes all of the aforementioned problems, while meeting the needs and desires of people living in institutional healthcare facilities.

SUMMARY OF THE INVENTION

Among the several objects and advantages of the present invention include:

The provision of a lap robe for wheelchair or sitting patients;

The provision of such aforementioned lap robe which affords both comfort and convenience to the user, when both sitting and moving about short distances;

The provision of such aforementioned lap robe which generally conforms to the body shape of the user, such as allowing bending and general shaping of the lab robe to the user's body shape, while moving from a standing to a sitting position;

The provision of such aforementioned lap robe which further offers dignity to the user, by concealing medical abnormalities such as one leg, other disfigurements and diseases of advancing age;

The provision of such aforementioned lap robe which also provides warmth as a thermal barrier, while also being ornamentally configured in an aesthetically pleasing product design; and The provision of such aforementioned lap robe which is durable and long lasting, has all of the features available to synthetic products, and saves substantial processing costs in cleaning and maintaining such products.

Briefly stated, the lap robe for wheelchair or sitting patients of the present invention includes a waist section having detachable fastening elements attached thereto, and a lower body and leg wrapping section attached to the waist section. The lower body and leg wrapping section includes upper and lower portions, the upper portion extending laterally outwardly from the lower portion on opposite sides of the lower body and leg wrapping section. This enables the lap robe to be conveniently placed about a patient with the upper portion of the lower body and leg wrapping section generally conforming to the patient's lower body and thighs when both in a standing and sitting position, while the lower portion of the lower body and leg wrapping section also cover the lower leg areas of the patient. The lap robe may also be reversible, and further include pockets on one or both sides for the convenience of the patient. Also, the lap robe may be made from a thermal barrier material also having an ornamental configuration.

These and other objects and advantages of the present invention will become more apparent for the ensuing description.

DESCRIPTION OF THE PREFERRED EMBODIMENT

Figure 1:
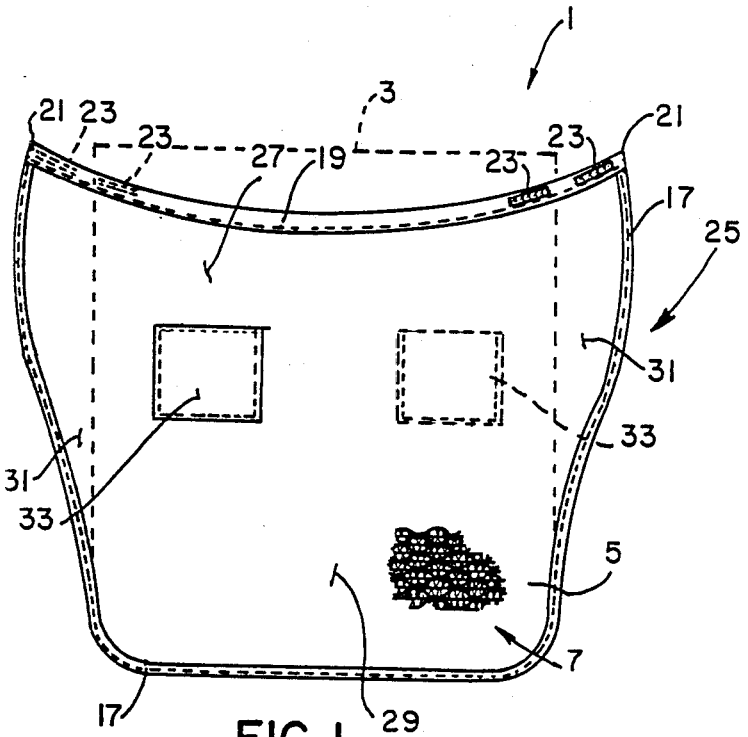
FIG. 1 is a top plan view of the reversible lap robe which is constructed in accordance with the teachings of the present invention.

As shown in FIG. 1 of the drawing, the reversible lap robe 1 has been uniquely configured, shaped and constructed for the healthcare of wheelchair or sitting patients in retirement communities, nursing homes and other public institutions. To facilitate an understanding of the reversible lap robe 1, a dotted line rectangle 3 has been drawn over the reversible lap robe 1 to assist in a visual understanding and appreciation of the unique differences of the reversible lap robe of the present invention, as compared to a variety of other clothing articles such as aprons and the like, blankets or other covers.

The body 5 of the reversible lap robe 1 is preferably constructed from a synthetic fiber healthcare fabric 7 which is disclosed in my co-pending patent application Ser. No. 199,766 entitled Synthetic Fiber Healthcare Fabric filed on Apr. 27, 1988. As disclosed in this co-pending patent application, the synthetic fiber healthcare fabric 7 is constructed as a light weight, air permeable, thermal barrier and soft fabric feeling material for a variety of new healthcare product applications including blankets and the reversible lap robe 1 of the present invention.

Figure 3:
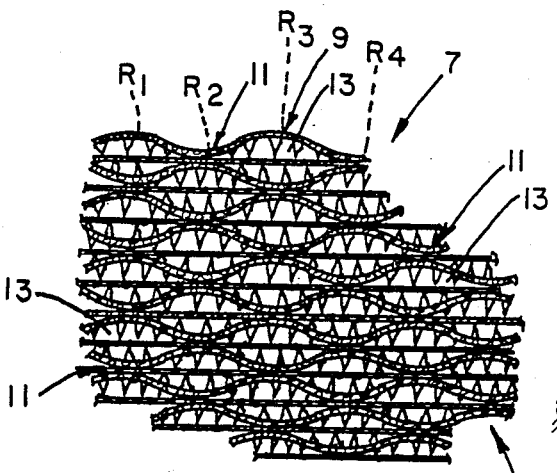
FIG. 3 is a fragmentary enlarged top plan view illustrating the synthetic fiber healthcare fabric from which the reversible lap robe is constructed.
Figure 4:
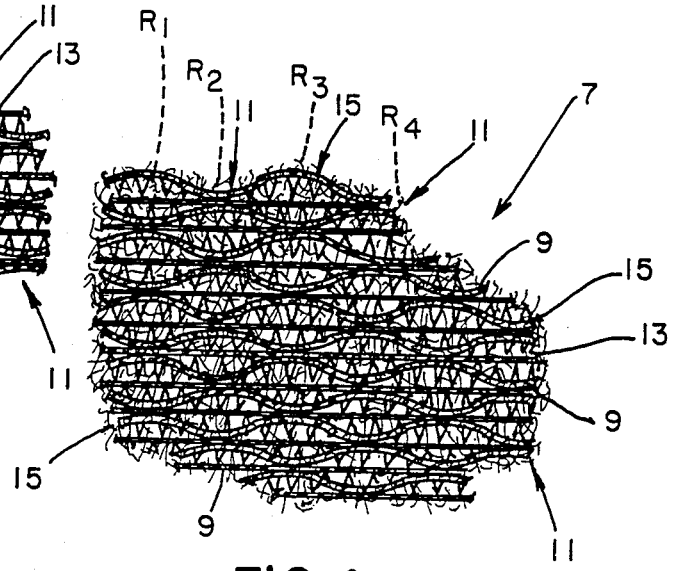
FIG. 4 is also an enlarged fragmentary top plan view of the synthetic fiber healthcare fabric which illustrates the napping or brushing of the synthetic fibers.

As shown in FIGS. 3 and 4 of the drawing, the synthetic healthcare fabric 7 includes a repeating pattern of synthetic fiber filaments 9 which are arranged in an open-work construction throughout the fabric as illustrated in FIGS. 3–4. The fabric includes a plurality of laterally spaced groups 11 of closely positioned synthetic fiber filaments 9 arranged in a plurality of adjacent rows, the laterally spaced groups 11 of closely positioned synthetic fiber filaments 9 in immediately adjacent rows being laterally offset from one another, while being longitudinally aligned with laterally spaced groups 11 of closely positioned synthetic fiber filaments 9 in alternating rows. Specifically, the laterally spaced groups 11 in rows R1 and R2, for example, are laterally offset from one another, while the laterally spaced groups 11 of closely positioned synthetic fiber filaments 9 in alternating rows R1 and R3, for example, are longitudinally aligned with one another, as can be seen in FIGS. 3–4.

The area between adjacent pairs of laterally spaced groups 11 of closely positioned synthetic fiber filaments 9 and adjacent pairs of longitudinally aligned groups 11 of closely positioned synthetic filaments 9 defines a generally elongated opening 13, which give the visual appearance of being generally elongated and polygonally shaped so as to provide an ornamentally pleasing and aesthetic aesthetic product. The plurality of generally elongated openings 13 thereby provides airflow through the synthetic fiber healthcare fabric 7, while providing a lightweight construction.

FIG. 3 illustrates the synthetic fiber healthcare fabric 7 prior to having a napped or brushed finish applied thereto. In FIG. 4 of the drawings, the synthetic fiber filaments 9 are shown as having a napped or brushed finish throughout the synthetic fiber healthcare fabric 7 on at least one side thereof, in order to provide a series of randomly extending short fiber filaments 15 which project from the synthetic fiber filaments 9, so as to provide an effective thermal barrier construction, while also having a soft fabric feel.

For a more detailed description and discussion of the construction of the synthetic fiber healthcare fabric 7, reference is made to my aforementioned co-pending patent application.

With reference specifically now to the reversible lap robe 1 of the present invention, it will be seen that the body 5 of the reversible lap robe 1 has a configuration materially different from the dotted line rectangle 3 shown in FIG. 1. The body 5 preferably comprises a one-piece garment formed from the synthetic fiber healthcare fabric 7, with the outer edge thereof being folded back upon itself to provide a series of seams 17 that are sewn or stitched, as is quite common.

Figure 2B:
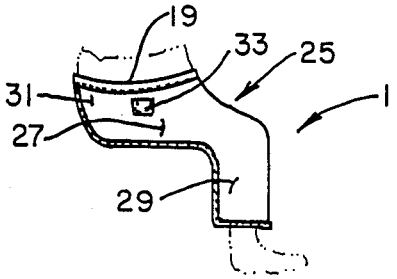
FIG. 2B is also a side elevational view of the reversible lap robe wrapped around a patient while in sitting position.
Figure 2A:
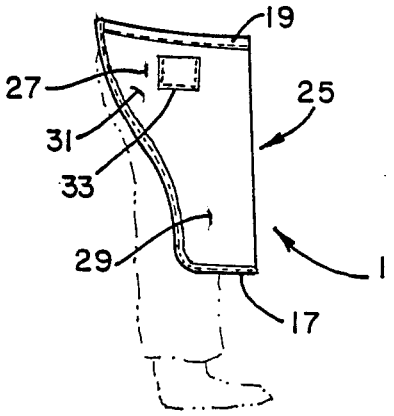
FIG. 2A is a side elevation view illustrating the reversible lap robe being wrapped about a patient in standing position.

It will be noted that the seam 19 across the top of the reversible lap robe 1, as seen in FIG. 1, is provided with a wider seam 19 to assist in forming a waist section 19 that is curvilinearly and symmetrically shaped across the width of the reversible lap robe 1 to facilitate wrapping about the natural body shape of patients. Adjacent the opposite ends 21, 21 of the waist section 19 are pairs of spaced detachable fastening elements 23, 23 which are designed to cooperate with the detachable fastening elements 23, 23 at the opposite end 21 of the waist section 19. The detachable waist elements may be constructed as a "Velcro-type" or other detachable fasteners having other suitable constructions, in order to allow a patient to wrap the reversible lap robe 1 quickly and conveniently about the waist of a patient, while also facilitating easy removal therefrom, as will be appreciated. When the reversible lap robe 1 is wrapped about a patient, as illustrated in FIG. 2A, the waist section 19 totally envelopes the patient's waist, as shown in FIG. 2A of the drawings.

Below the waist section 19 is an integrally attached lower body and leg wrapping section 25 which is designed to be arranged about a patient's lower body and leg section areas. Specifically, the lower body and leg wrapping section 25 includes an upper portion 27 and lower portion 29, as best seen in FIGS. 1–2A and 2B. The lower portion 29 is arranged to extend generally within the confines of the phantom rectangle 3, and when used with a patient, will generally cover the lower leg areas of the patient when both standing, as shown in FIG. 2A, and when sitting, as shown in FIG. 2B. The upper portion 27 of the lower body and leg wrapping section 25 has opposite side portions thereof which are curvilinearly shaped and extend upwardly and outwardly from the lower portion 29 as at 31 on opposite sides of the reversible lap robe 1. Thus, when the waist section 19 is wrapped about a patient's body as shown in FIG. 2A, the curvilinearly upwardly and outwardly shaped side portions 31, 31 of the reversible lap robe 1 are arranged to extend along at least a part of the sides and the rear portion of a patient's body, as shown in FIG. 2A. Upon sitting, as shown in FIG. 2B, the curvilinearly shaped upwardly and outwardly extending side portions 31, 31 are arranged to be trapped between the patient's body and the sitting surface, so as to generally conform to at least part of the patient's lower body. The lower portion 29 of the lower body and leg wrapping section 25 will then extend over the lower leg areas of the patient in a loose fitting arrangement to allow for movement of the patient's legs within the reversible lap robe 1.

For convenience and use by the patient, a pocket(s) 33 may be provided on 1 or both sides of the reversible lap robe 1, as desired to receive personal articles from the patient. As seen in FIGS. 1, 2A and 2B, the pocket(s) 33 are set to one side of the reversible lap robe 1, in order to be located for easy access and use by the patient.

From the foregoing, it will readily be appreciated that the reversible lap robe of the present invention readily conforms to the lower body and legs of a patient when both standing and sitting. Specifically, the reversible lap robe generally conforms to the lower body and thighs of the patient in a generally close conforming relation thereto. The reversible lap robe also covers while facilitating movement of the patient's legs. This gives both warmth and dignity of the patient. By using a synthetic fiber healthcare fabric as the material from which the reversible lap robe is made, a relatively lightweight, air permeable, thermal barrier and soft fabric feel material can be utilized to enhance patient comfort.

In view of the above, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

I claim:

1. A lap robe for wheelchair or sitting patients comprising:

a waist section having detachable fastening elements attached thereto;

a lower body and leg wrapping section attached to said waist section and including lower and upper portions;

the lower portion of said lower body and leg wrapping section having a width sufficient to cover leg areas of a patient below the thighs in a loose fitting arrangement when both standing and sitting; and the upper portion of said lower body and leg wrapping section extending laterally outwardly beyond the lower portion of said lower body and leg wrapping section and being configured, arranged and dimensioned to both wrap around and generally conform in close fitting relationship to the patient's lower body and thighs when both standing and sitting.

2. The lap robe as defined in claim 1 and including a pocket on at least one outer facing surface of said lower body and leg wrapping section.

3. The lap robe as defined in claim 2 wherein said lap robe is reversible and includes reversible detachable fastening elements and pockets on both of said outer facing surfaces thereof said pockets being in non-symmetrical and non-aligned locations on said outer facing surfaces.

4. The lap robe as defined in claim 3 wherein said waist section is curvilinearly and symmetrically shaped across the width of the lap robe to facilitate wrapping about the natural body shape of patients.

5. The lap robe as defined in claim 4 wherein the upper portion of said lower body and leg wrapping section on opposite sides thereof is curvilinearly shaped upwardly and outwardly with respect to the lower portion of said lower body and leg wrapping section and being in close fitting conforming relationship to the lower body and thighs of a patient.

6. The lap robe as defined in claim 5 wherein said lap robe is made from a thermal barrier material also having an ornamental configuration.

7. The lap robe as defined in claim 6 wherein said lap robe includes a synthetic fiber healthcare fabric having a repeating pattern of synthetic fiber filaments arranged in an open work construction throughout the fabric.

* * * * *

UNITED STATES PATENT AND TRADEMARK OFFICE

CERTIFICATE OF CORRECTION

PATENT NO. : 4,833,731

DATED : May 30, 1989

INVENTOR(S) : Charles Foxman

It is certified that error appears in the above-identified patent and that said Letters Patent is hereby corrected as shown below:

On the title page:

Abstract, line 7, "an" should be ---on---.

Signed and Sealed this

Third Day of April, 1990

*Attest:*

*Attesting Officer*

HARRY F. MANBECK, JR.

*Commissioner of Patents and Trademarks*